United States Patent [19]

Okumura

[11] Patent Number: 4,708,725

[45] Date of Patent: Nov. 24, 1987

[54] CRYOGENIC REFRIGERATOR

[75] Inventor: Nobuo Okumura, Toyota, Japan

[73] Assignee: Aisin Seiki Kabushiki Kaisha, Kariya, Japan

[21] Appl. No.: 931,038

[22] Filed: Nov. 17, 1986

[30] Foreign Application Priority Data

Nov. 16, 1985 [JP] Japan ..... 60-257294

[51] Int. Cl.[4] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 2,966,035 | 12/1960 | Gifford | 62/6 |
| 3,546,876 | 12/1970 | Fokker | 62/6 |
| 3,609,982 | 10/1971 | O'Neil et al. | 62/6 |
| 3,650,118 | 3/1972 | O'Neil | 62/6 |
| 4,235,078 | 11/1980 | Morbidi | 62/6 |
| 4,400,941 | 8/1983 | Rauch | 60/520 |
| 4,462,212 | 7/1984 | Knoos | 62/6 |

*Primary Examiner*—Ronald C. Capossela

*Attorney, Agent, or Firm*—Burns, Doane, Swecker & Mathis

[57] ABSTRACT

A cryogenic refrigerator has an upper chamber formed at an upper end portion of a cylinder above a displacer. An upper end portion of a rod is movable in a bore and lower end portion of the rod is connected to an upper end portion of the displacer. Pressure varies in the upper chamber between high and low values upon movement of the displacer. The bore is always supplied with low-pressure such that the displacer may be moved by the differential pressure between the upper chamber and the bore.

9 Claims, 3 Drawing Figures

10
32
40
50
22
21
33
20
43
13
30
31
11
12

CRYOGENIC REFRIGERATOR

BACKGROUND OF THE INVENTION

The present invention relates to a cryogenic refrigerator, and in particular to a cryogenic refrigerator of Gifford-McMahon cycle type.

Conventional cryogenic refrigerators of the type, disclosed in U.S. Pat. No. 2,966,035, include a cylinder within which a displacer is slidably fitted. At opposite end portions of the displacer within the cylinder, there are defined an upper chamber and a lower chamber, respectively. An upper end portion of the displacer is connected to a lower end portion of a rod and an upper end portion of the rod is extended in a casing. The casing is adjacent to the upper chamber but is separated fluidically therefrom. A motor is operatively connected via a crank to the rod so as to move the displacer cyclically.

However, the motor has to move the rod against force applied thereto. Such force F is so large, as is apparent from the following formula, that the motor has to be one with high power.

F = cross-sectional area of the rod × (pressure of fluid in the upper chamber − pressure of fluid in the casing)

SUMMARY OF THE INVENTION

Therefore, it is an object of the present invention, among others, to provide a cryogenic refrigerator in which the force applied to the rod may be reduced.

BRIEF DESCRIPTION OF THE DRAWINGS

Preferred embodiments of the present invention will be discussed in greater detail with reference to the accompanying drawings, wherein like members bear like reference numerals and wherein.

DETAILED DESCRIPTION OF THE PREFERRED EMBODIMENTS

Figure 1:
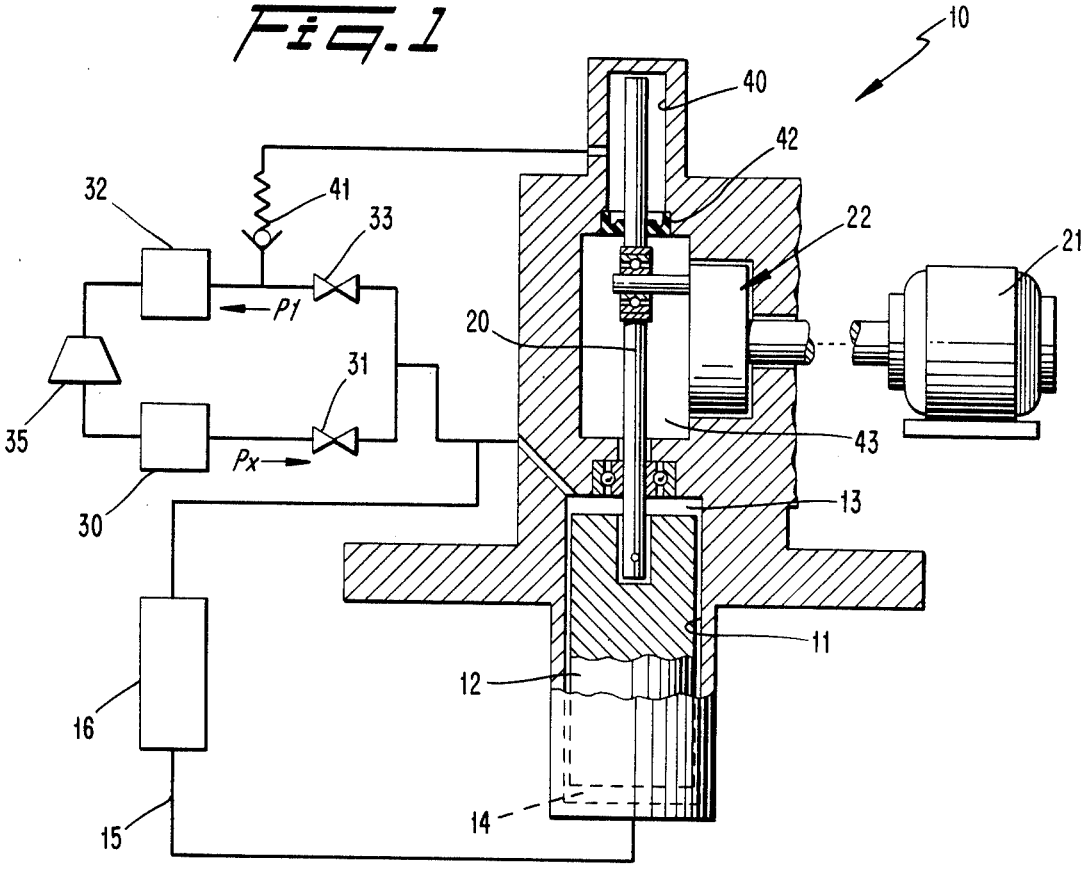
FIG. 1 is a schematic, cross-sectional view of one embodiment of a cryogenic refrigerator according to the present invention.

Referring now to FIG. 1, a cryogenic refrigerator 10 of the Gifford-McMahon cycle type has a cylinder 11 within which a displacer or piston 12 is slidably fitted. At opposite end portions of the displacer 12, there are formed an upper chamber 13 and a lower chamber 14 within the cylinder 11. Volumes of both chambers 13, 14 are defined by the movement of the displacer 12. The upper chamber 13 and the lower chamber 14 are fluidically connected with each other by a conduit 15 in which a regenerator 16 serving as a thermal storage means is disposed.

A rod 20 is connected at a lower end portion thereof to an upper end portion of the displacer 12. A middle portion of the rod 20 is operatively connected to a motor 21 through a crank mechanism 22 to move the displacer 12 in cyclical or reciprocal movement upon actuation of the motor 21. The cyclical movement of the displacer 12 consists of four steps. In a first step, the displacer 12 is positioned in an uppermost position in the cylinder 11; in a second step, the displacer 12 is in downward movement; in a third step, the displacer 12 is positioned in a lowermost position in the cylinder 11; and in a fourth step, the displacer 12 is in upward movement.

A first reservoir 30 of high-pressure fluid such as helium gas is in fluid communication with the upper chamber 13 and the conduit 15 through a first valve 31. Also, a second reservoir 32 of low-pressure fluid is in fluid communication with the upper chamber 13 and the conduit 15 through a second valve 33. A compressor 35 is interposed between the first and second reservoirs 30, 32.

The first valve 31 is controlled in synchronization with the movement of the displacer 12 such that high-pressure fluid is fed into the upper chamber 13 and the conduit 15 while the displacer 12 is in the first and second steps thereof. The second valve 33 is also controlled in synchronization with the movement of the displacer 12 such that low-pressure fluid is exhausted while the displacer 12 is in the third and fourth steps thereof. As a result of such cyclical movement of the displacer 12, well-known as the Gifford-McMahon cycle, refrigeration may be extracted from a portion near the lower chamber 14 by suitable means (not shown). During one cyclical movement of the displacer 12, pressure in the upper chamber 13 varies between a maximum, Px, and a minimum, P1. The first valve 31 and the second valve 33 may be replaced by a single three-port valve (not shown). Thus, a set of the valves 31, 33 or the three-port valve may be referred as valve means for controlling the flow of fluid to and from the cylinder.

An upper end portion of the rod 20 is extended into a bore 40 into which low-pressure fluid from the reservoir 32 is always supplied via a one-way valve 41. The bore 40 is arranged above and fluidly separated by a seal 42 from a crank chamber 43 in which the crank mechanism 22 is located.

Figure 2:
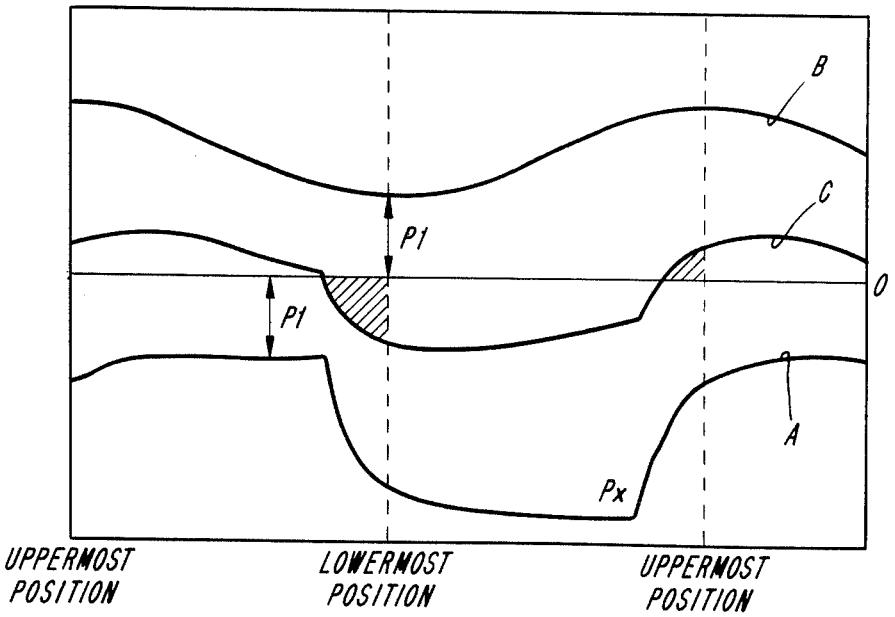
FIG. 2 is a graph showing the force applied to a rod of the cryogenic refrigerator in FIG. 1.

As mentioned above, pressure in the upper chamber 13 varies between the maximum Px and the minimum P1 and low-pressure fluid is always being supplied to the bore 40. The pressure in the upper chamber 13 and the low pressure fluid in the bore 40 are represented by a curve A and curve B, respectively, in FIG. 2. Curve C in FIG. 2 is a result of the composition of curves A and B, and shows the magnitude and direction of force applied to the displacer 12. By analyzing Curve C with reference to the location of the displacer 12 as shown on the horizontal axis in FIG. 2, it is appreciated that the displacer 12 may be moved cyclically by only the force represented with Curve C. That is, the displacer 12 is being applied with downward (upward) force during downward (upward) movement thereof, in principle. Such condition is maintained in the range of approximately 300 degrees of the full 360 degrees rotation of the crank mechanism 22. While the displacer 12 is just before the lowermost (uppermost) position thereof, upward (downward) force as shaded in FIG. 2 is applied to the displacer 12, in spite of downward (upward) movement of the displacer 12. Such a temporary, short term condition may be neglected.

Figure 3:
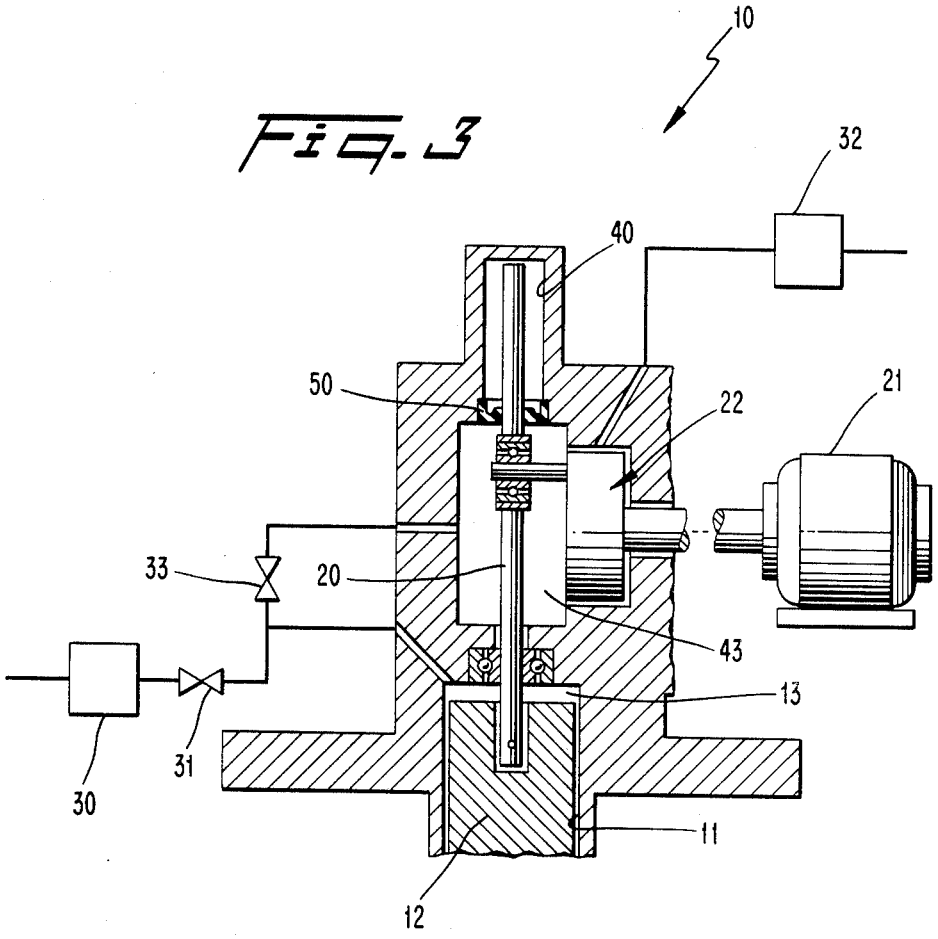
FIG. 3 is a schematic, cross-sectional view of another embodiment of the present invention.

In another embodiment of the present invention (FIG. 3), the crank chamber 43 is located between the second reservoir 32 of low-pressure fluid and the second valve 33. A one-way valve 50, in the form of lip-shaped member, is interposed between the bore 40 and the crank chamber 43. Thus, low-pressure or exhaust pressure is always being supplied from the crank chamber 43 to the bore 40 through the one-way valve 50.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A cryogenic refrigerator comprising, a cylinder;

a displacer movable within said cylinder;

an upper chamber formed at an upper end portion of said cylinder above said displacer;

a lower chamber formed at a lower end portion of said cylinder below said displacer;

the volumes of said upper and lower chambers being defined by the movement of said displacer;

a conduit connecting said upper chamber and said lower chamber;

a regenerator arranged in said conduit;

a rod, a lower end portion of the rod being connected to an upper end portion of said displacer;

a motor operatively connected to said rod through crank means for moving said displacer in a cycle consisting of a first step at which said displacer is in an uppermost position in the cylinder, a second step at which said displacer is in downward movement, a third step at which said displacer is in a lowermost position in the cylinder, and a fourth step at which said displacer is in upward movement;

a supply reservoir for supplying high-pressure fluid;

an exhaust reservoir for receiving low-pressure fluid;

valve means associated with said supply and exhaust reservoirs and controlled for delivering high-pressure fluid into said upper chamber and said conduit while said displacer is at the first and second steps of and for exhausting low-pressure fluid while said displacer is at the third and fourth steps;

a bore movably receiving an upper end portion of said rod, said bore being fluidly separated from said upper chamber; and, a one-way valve for supplying low-pressure fluid continually to said bore.

2. The cryogenic refrigerator in accordance with claim 1, wherein said one-way valve is disposed between said bore and a crank chamber in which said crank means is located, and said crank chamber is in the path of low-pressure fluid to be received in said exhaust reservoir.

3. The cryogenic refrigerator in accordance with claim 1, further comprising a seal between said bore and a crank chamber in which said crank means is located, the one-way valve supplying low-pressure fluid to said bore above said seal.

4. The cryogenic refrigerator in accordance with claim 1, wherein the low-pressure fluid in the bore and the varying pressure in the upper chamber produce an overall force complementary to the movement of the displacer over approximately 300 degrees of rotation of the crank means.

5. A cryogenic refrigerator comprising, a cylinder;

a displacer movable within said cylinder;

an upper chamber formed at an upper end portion of said cylinder above said displacer;

a lower chamber formed at a lower end portion of said cylinder below said displacer;

the volumes of said upper and lower chambers being defined by the movement of said displacer;

a rod, a lower end portion of the rod being connected to an upper end portion of said displacer;

a motor operatively connected to said rod through crank means for moving said displacer in cyclical movement;

a supply reservoir for supplying high-pressure fluid to the cylinder;

an exhaust reservoir for receiving low-pressure fluid from the cylinder;

valve means associated with said supply and exhaust reservoirs for controlling delivery of high-pressure fluid to the cylinder and for exhausting low-pressure fluid from the cylinder;

a bore movably receiving an upper end portion of said rod, said bore being fluidly separated from said upper chamber; and, means for supplying low-pressure fluid continually to said bore.

6. The cryogenic refrigerator in accordance with claim 5, wherein said bore is arranged above a crank chamber in which said crank mechanism is located.

7. The cryogenic refrigerator in accordance with claim 5, wherein the means for supplying low-pressure fluid to the bore includes a one-way valve.

8. The cryogenic refrigerator in accordance with claim 7, wherein said one-way valve is disposed between said bore and a crank chamber in which said crank means is located, said crank chamber being in the path of low-pressure fluid to be received in said exhaust reservoir.

9. The cryogenic refrigerator in accordance with claim 7, further comprising a seal between said bore and a crank chamber in which said crank means is located, the one-way valve supplying low-pressure fluid to said bore above said seal.

* * * * *